US008270627B2

(12) United States Patent
Abe et al.

(10) Patent No.: US 8,270,627 B2
(45) **Date of Patent: *Sep. 18, 2012**

(54) ADAPTIVE NOISE CONTROL SYSTEM

(75) Inventors: Takeshi Abe, Garden City, MI (US); Robert G. Rebandt, II, Wayne, MI (US); Ming-te Cheng, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1184 days.

This patent is subject to a terminal disclaimer.

(21) Appl. No.: 11/638,828

(22) Filed: Dec. 14, 2006

(65) Prior Publication Data

US 2008/0144849 A1 Jun. 19, 2008

(51) Int. Cl.
*G10K 11/16* (2006.01)

(52) U.S. Cl. ..... 381/71.4; 381/86; 381/302; 181/199; 181/295; 181/296

(58) Field of Classification Search ..... 381/71.1, 381/71.3–71.4, 86, 66, 302; 181/206, 293, 181/199, 148, 295, 296
See application file for complete search history.

(56) References Cited

U.S. PATENT DOCUMENTS

| | | | | |
|---|---|---|---|---|
| 4,506,380 | A | 3/1985 | Matsui | 381/71 |
| 4,574,915 | A | 3/1986 | Gahlaii | 181/290 |
| 5,088,571 | A * | 2/1992 | Burry et al. | 180/90 |
| 5,094,318 | A | 3/1992 | Maeda | 181/290 |
| 5,131,047 | A | 7/1992 | Hashimoto | 381/71 |
| 5,321,759 | A | 6/1994 | Yuan | 381/71 |
| 5,386,372 | A * | 1/1995 | Kobayashi et al. | 700/280 |
| 5,554,831 | A | 9/1996 | Matsukawa | 181/294 |
| 5,817,408 | A | 10/1998 | Orimo | 428/218 |
| 6,078,673 | A * | 6/2000 | von Flotow et al. | 381/71.7 |
| 6,102,465 | A | 8/2000 | Nemoto | 296/36.3 |
| 6,305,294 | B1 | 10/2001 | Hashino | 104/91 |
| 6,343,127 | B1 * | 1/2002 | Billoud | 381/71.4 |
| 6,554,101 | B2 | 4/2003 | Watanabe | 181/290 |
| 6,589,643 | B2 | 7/2003 | Okada | 428/297.4 |
| 6,767,050 | B2 | 7/2004 | Junker | 296/193.02 |
| 7,017,250 | B2 | 3/2006 | Gebreselassie | 29/428 |
| 7,070,848 | B2 | 7/2006 | Campbell | 428/137 |
| 7,536,018 | B2 * | 5/2009 | Onishi et al. | 381/71.8 |
| 2004/0130081 | A1 | 7/2004 | Hein | 267/140.14 |
| 2004/0161119 | A1 * | 8/2004 | Patton | 381/71.2 |
| 2004/0240678 | A1 | 12/2004 | Nakamura | 381/71.11 |
| 2005/0150720 | A1 | 7/2005 | Tudor | 181/286 |
| 2007/0003071 | A1 * | 1/2007 | Slapak et al. | 381/71.1 |

* cited by examiner

*Primary Examiner* — Disler Paul
(74) *Attorney, Agent, or Firm* — Gregory P. Brown; MacMillan, Sobanski & Todd, LLC

(57) ABSTRACT

An adaptive noise control system is deployed in a box-like structure positioned within the transfer path along which the noise is being transmitted from the source of the generated noise to the receiver of the noise in the passenger compartment of an automobile. The adaptive noise control system is can be deployed in the dual bulkhead of the vehicle dashboard to provide a constrained volume within which engine noise can be controlled. The adaptive control system generates a mathematical model of the noise to be controlled in response to the acoustic environment identified by sensors placed within the engine compartment. Sensors in the passenger compartment define the effectiveness of the noise control system. The controller is operable to update the mathematical model in response to the changes in the acoustic environment, thus providing the appropriate acoustic response within the dual bulkhead plenum for control of noise along the transfer path.

12 Claims, 2 Drawing Sheets

Fig. 1
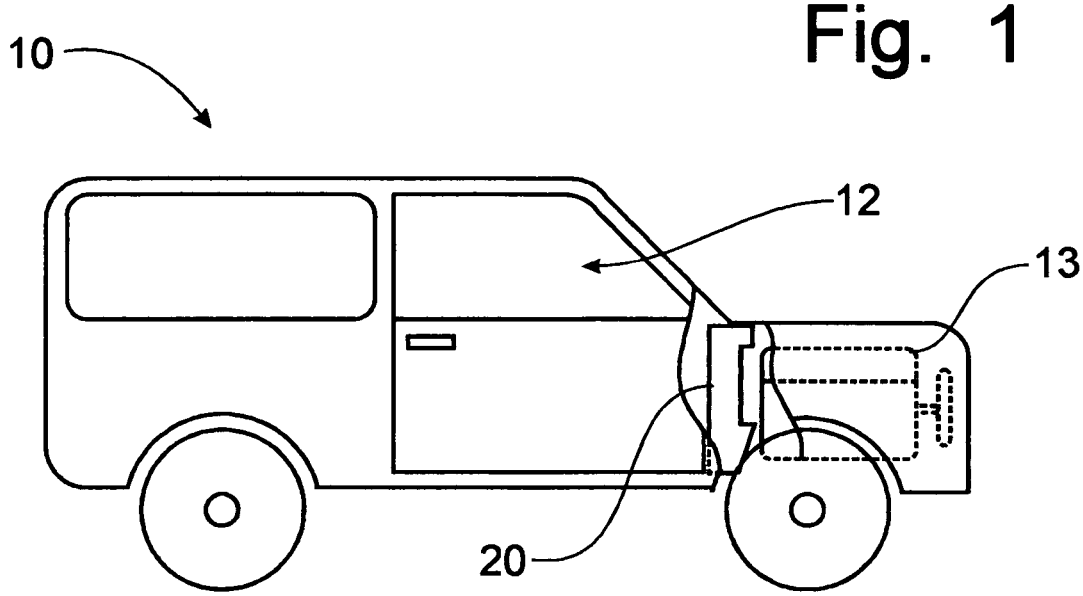
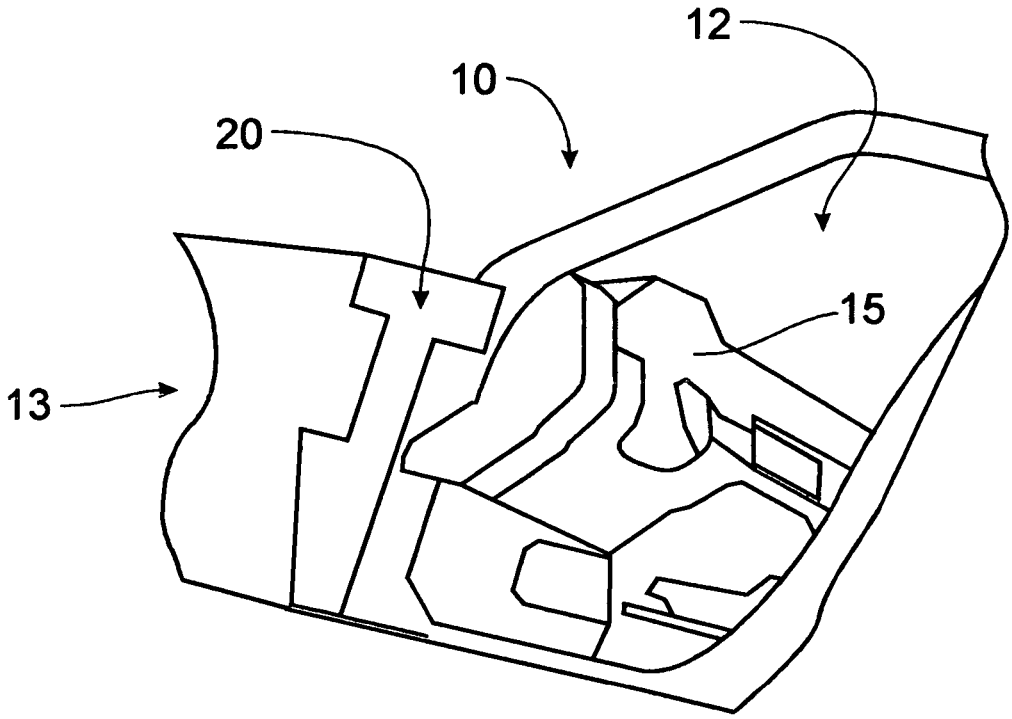
Fig. 2

Fig. 3
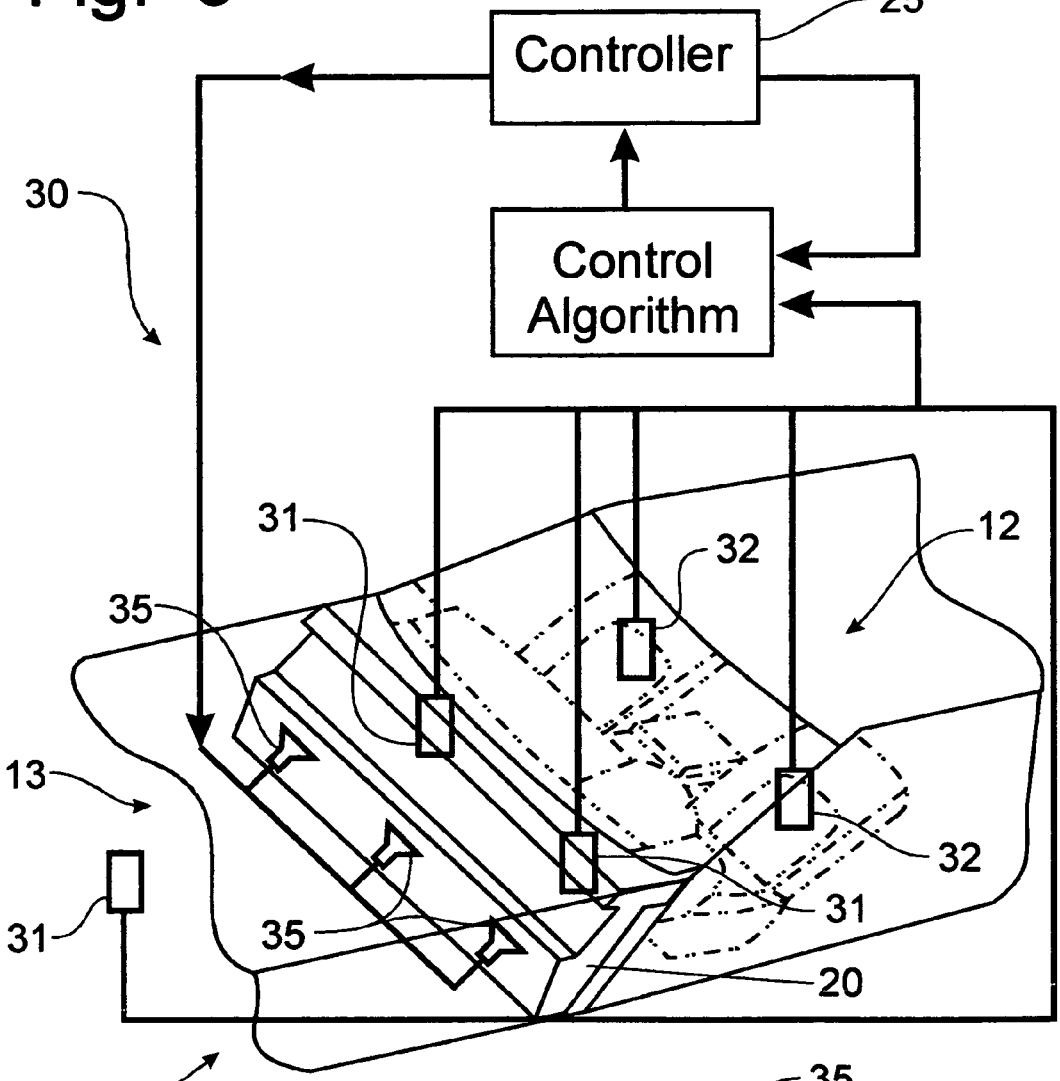
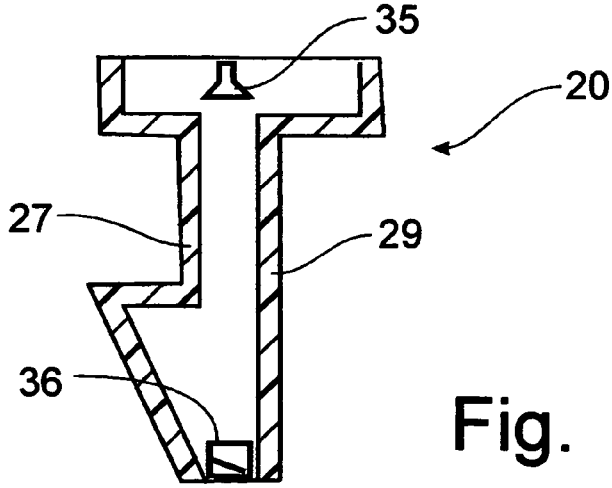
Fig. 4

ADAPTIVE NOISE CONTROL SYSTEM

FIELD OF THE INVENTION

This invention relates generally to the control the noise generated by an automotive vehicle and, more particularly, to the reduction of noise in the passenger compartment of an automotive vehicle by controlling the transmission of the noise along the acoustic transfer path from the source of the noise to the receiver of the noise with an adaptive system that develops an acoustic response through a mathematical model.

BACKGROUND OF THE INVENTION

The operation of the powertrain in an automobile is one of the major contributors of noise received within the passenger compartment of the automobile. With new powertrain technology, such as electronic valve actuation and variable displacement engine, new methods are needed to control the interior noise. In order to improve customer perceived interior noise quality, passenger compartment active noise control has been a popular strategy for study. Such methods of noise control are discussed below relative to prior art documents. Generally, these methods are expensive and only control the receiving end of the problem such as the passenger driver's ear positions, which can affect the speech intelligence to the passenger. Other methods of controlling noise are directed to the source, such as an active control of the induction or exhaust systems, have been developed. However, active control capability is limited and is very complex and expensive. Therefore, active noise control systems have not proven to be popular even though the methodology and technical capability have existed for many years.

An example of active passenger cabin sound suppression technology can be found in U.S. Pat. No. 4,506,380 granted to Shinichi Matsui on Mar. 19, 1985, in which speakers disposed in the dash panel of the vehicle are individually energized to selectively control the resonance occurred with respect to engine vibration. Similarly, an active vibration/noise control system in taught in U.S. Pat. No. 5,386,372, issued on Jan. 31, 1995, to Toshiski Kobayashi, et al, wherein speakers are arranged in suitable locations in the dashboard of the passenger compartment to control the noise from the engine. Self-expanding engine mounts have actuators formed of piezo-electric elements or magnetostrictive elements to prevent the vibrations from being transmitted from the engine.

Passive sound-absorbing materials are utilized throughout an automotive vehicle to reduce noise transmission. An example is found in U.S. Pat. No. 7,017,250, issued to Girma Gebreselassie, et al, on Mar. 28, 2006, wherein a dash insulator system has a substrate made from foam that is used to absorb the sound directed to a dash insulator. In U.S. Pat. No. 4,574,915, granted to Heinemann Gahlaii, et al on Mar. 11, 1986, sound-insulating cladding, formed from viscoelastic foam material is secured on the face of the front bulkhead to provide a sound-insulated area. Sound absorbing materials are used in the dashboard area of the vehicle to provide a passive noise control system preventing the noise generated in the engine compartment from being transmitted to the passenger compartment, as is suggested in U.S. Pat. No. 5,094,318, granted to Takashi Maeda, et al on Mar. 10, 1992; in U.S. Pat. No. 5,554,831, granted to Hiroshi Matsukawa, et al on Sep. 10, 1996; in U.S. Pat. No. 5,817,408, granted to Motohiro Orimo, et al on Oct. 6, 1998; in U.S. Pat. No. 6,102,465, granted to Kouichi Nemoto on Aug. 15, 2000; and in U.S. Pat. No. 6,554,101 granted to Kyoichi Watanabe on Apr. 29, 2003.

An isolator system, comprised of cast foam, is affixed to horizontal and vertical portions of the vehicle dash panel to reduce the transmission of unwanted noise and vibration from the engine compartment is taught in U.S. Pat. No. 6,767,050 granted to Christian Junker on Jul. 27, 2004, and assigned to Ford Global Technologies, LLC, and in U.S. Pat. No. 7,070,848 granted to Michael Campbell on Jul. 4, 2006. An automotive dash insulator system, used to reduce noise transmission from the engine to the interior of the vehicle, is formed with a sound-absorbing layer comprised of viscoelastic foam as depicted in U.S. Patent Application Publication No. 2005/0150720, of Jay Tudor, et al, published on Jul. 14, 2005.

A noise control system using a piezo-electric control scheme can be found in U.S. Pat. No. 6,589,643, granted on Jul. 8, 2003, to Jun Okada, et al, in which sound absorbing material, such as piezo-electric material, is used to insulate a dashboard in a vehicle to absorb and prevent the entry of low-frequency noise from the engine into the passenger compartment. In U.S. Patent Application Publication No. 2004/0130081 of David Hein, published on Jul. 8, 2004, a piezo-electric actuator and sensor assemblies are introduced between various structures contained within the instrument panel to minimize vibration within the instrument panel structure.

Adaptive filters have also been used to control noise generated from a noise source, such as the engine in an automobile, as taught in U.S. Pat. No. 5,131,047, issued to Hiroyuki Hashimoto, et al on Jul. 14, 1992, where a speaker is utilized to reproduce engine noise that controls the generated engine noise. In U.S. Pat. No. 5,321,759, granted to Yi Yuan on Jun. 14, 1994, adaptive filters having transversal filters are utilized in an active noise control system to control engine generated vibrational noise. A directional microphone is integrated into the dashboard to achieve a directional effect for controlling automotive noise is taught in U.S. Pat. No. 6,305,732, granted on Oct. 23, 2001, to Hans-Wilheim Ruhl. In U.S. Pat. No. 6,324,294, issued on Nov. 27, 2001 to Henry Azima, et al, loud speaker panels are attached to or installed in the dashboard of an automobile. U.S. Pat. Application Publication No. 2004/0240678 of Yoshio Nakamura, et al, published Dec. 2, 2004, discloses an active noise control system that uses a speaker to control problematic noise generated by the engine.

It would be desirable to provide a system for reducing engine noise that is directed to the transfer path, rather than the source or the receiver of the noise. It would also be desirable to provide a system that employs a mathematical model to define the acoustic response of the system within a box-like structure placed within the transfer path of the noise from the source to the receiver.

SUMMARY OF THE INVENTION

It is an object of this invention to overcome the aforementioned disadvantages of the known prior art by providing a noise control system that is directed to the transfer path of the noise transmission.

It is another object of this invention to provide an adaptive system for controlling noise generated at the engine that is deployed within the dual bulkhead plenum of an automotive dashboard.

It is a feature of this invention that the dual bulkhead plenum in the vehicle dashboard is located along the transfer path along which engine noise is transmitted into the passenger compartment.

It is an advantage of this invention that utilization of sound control techniques within the dual bulkhead plenum is directed to the transmission of the noise, as opposed to being directed to the source or receiver of the noise.

It is another advantage of this invention that the active acoustic transfer function provides an efficient control of the noise transmitted to the cabin of the automotive vehicle through the dash panel.

It is another feature of this invention that the constrained volume of the dual bulkhead plenum helps to provide a more efficient noise control system.

It is still another advantage of this invention that the deployment of simple hardware or software systems can provide a low cost and high capability active noise control within the dual bulkhead plenum of the vehicle dashboard to affect noise within the passenger compartment.

It is still another object of this invention to reduce the transmission of engine noise into the passenger compartment of an automotive vehicle by interrupting the transfer path of the noise transmission.

It is still another feature of this invention to provide an adaptive noise control system within the dual bulkhead plenum of an automotive dashboard.

It is yet another feature of this invention to utilize speakers within the dual bullhead plenum to control engine noise being transmitted through the plenum.

It is yet another advantage of this invention that the plenum can be damped with sound absorbing acoustic materials attached to the surface of the sheet metal forming the bulkhead.

It is a further advantage of this invention that the noise control system is placed in a less harsh environment than being utilized at the source of the noise.

It is still a further advantage of this invention that the noise control system can be adapted to any automotive vehicle utilizing a dual bulkhead instrument panel design.

It is still another object of this invention to provide a noise control system that utilizes an algorithm to develop a mathematical model to predict the characteristics of the noise being generated and transmitted to the passenger compartment through the dual bulkhead plenum.

It is a further feature of this invention that the acoustic response by the control apparatus within the dual bulkhead plenum is based on the mathematical model to provide an open loop control system.

It is still another advantage of this invention that the controller monitors the response and periodically updates the internal model of the system to adapt the mathematical model to the operating conditions.

It is still a further feature of this invention that sensors are utilized to define the operating conditions of the vehicle and to define the end result of the noise control system.

It is yet another advantage of this invention that the mathematical model is revised to adapt to the changes in the acoustic environment.

It is yet another object of this invention to provide an adaptive noise control system directed to the transmission transfer path of the noise, which is durable in construction, inexpensive of manufacture, carefree of maintenance, facile in assemblage, and simple and effective in use.

These and other objects, features and advantages are accomplished according to the instant invention by providing an adaptive noise control system operable within a box-like structure positioned within the transfer path along which the noise is being transmitted from the source of the generated noise to the receiver of the noise in the passenger compartment of an automobile. The adaptive noise control system is can be deployed in the dual bulkhead of the vehicle dashboard to provide a constrained volume within which engine noise can be controlled. The adaptive control system generates a mathematical model of the noise to be controlled in response to the acoustic environment identified by sensors placed within the engine compartment. Sensors in the passenger compartment define the effectiveness of the noise control system. The controller is operable to update the mathematical model in response to the changes in the acoustic environment, thus providing the appropriate acoustic response within the dual bulkhead plenum for control of noise along the transfer path.

BRIEF DESCRIPTION OF THE DRAWINGS

The advantages of this invention will become apparent upon consideration of the following detailed disclosure of the invention, especially when taken in conjunction with the accompanying drawings wherein:

FIG. 1 is a partial schematic side elevational view of an automotive vehicle having a noise control system incorporating the principles of the instant invention;

FIG. 2 is a partial schematic perspective view of an automotive vehicle having a dual bulkhead plenum into which the noise control system is deployed to control the transmission of engine noise into the passenger compartment;

FIG. 3 is a diagrammatic view of the active noise control system utilizing speakers mounted in the dual bulkhead plenum of the automotive instrumentation panel; and FIG. 4 is a schematic side elevational view of the dual bulkhead plenum to depict the application of acoustic material within the plenum.

DETAILED DESCRIPTION OF THE PREFERRED EMBODIMENT

Referring to FIGS. 1-4, an automotive vehicle incorporating the principles of the instant invention can best be seen. The control of undesirable noise intruding into the passenger compartment of an automobile has been the subject of recent development. Some noise control systems take the approach of countering the sound waves after they enter the passenger compartment, such as by introducing opposing sound waves via speakers appropriately arranged within the passenger compartment. Other noise control systems take the approach of countering the sound waves at the point of generation, such as by introducing opposing sound waves by speakers located appropriately within and/or around the engine, such as a speaker positioned at the air intake for the engine. The instant invention takes a unique approach to the control of noise by countering the sound waves along the transfer path of the noise, as opposed to at the receiver or at the generator.

To control acoustic transfer functions between the source, e.g. the engine 13, and the receiver, e.g. the passenger cabin 12 of the automobile 10, a box-like structure, which is defined with respect to the instant application as being a structure having a fixed volume, is placed along the transfer path between the generator and receiver. In some automotive vehicles 10, the instrument panel 15 is provided with a dual bulkhead plenum 20 located between the engine 13 and the passenger compartment 12. The dual bulkhead plenum 20 provides a suitable box-like structure for controlling the transfer of sound waves or vibrations along the transfer path through the instrument panel 15 in to the passenger compartment 12. Due to the lower level of sound or vibrational energy passing through the plenum 20 and the constrained volume of the plenum 20, very low cost, yet high capability, active noise control system can be utilized within the plenum 20 utilizing relatively simple hardware and software systems.

The noise control system 30 can include sensors 31 within the engine compartment to identify the frequency and amplitude of the sound energy being produced by the engine 13 for transfer to the passenger compartment 12 through the dual bulkhead plenum 20, and sensors 32 within the passenger compartment 12 to identify the frequency and amplitude of the sound energy being transmitted into the passenger compartment 12. These sensors 31 ascertain the acoustic environment of the vehicle 10 and can sense conditions such as temperature, vehicle speed, and engine RPM's. Thus, these sensors 31 can be utilized in an open loop control system employing a control algorithm that can result in the production of a counteracting sound wave introduced by speakers 35 within the plenum 20. The controller 25 employs a mathematical model of the vehicle's acoustic response to these environmental conditions through the control algorithm and generates the counteracting sound wave in response to the predicted sound energy level.

Accordingly, speakers 35 are placed within the plenum 20 to introduce the countering sound energy to control the sound waves being transmitted along the transfer path through the plenum 20. Vibrational energy can also be countered by opposing counteractive vibrational energy, which can be induced into the plenum 20 by a vibrator 36, schematically depicted in FIG. 4, that generates a vibration in the walls of the plenum that has an opposite amplitude and frequency to the vibrations emanating from the engine 13 or other vehicle component and being transmitted through the plenum 20. As an alternative to providing opposing amplitude and frequency to the sound and/or vibrations passing through the plenum 20, the speakers 35 and/or vibrators 36 can shape the sound being transmitted through the plenum 20 by providing partially opposing amplitude and frequency, thus allowing predetermined sounds or vibrations to reach the passenger compartment.

Instead of the traditional feed forward/feedback active noise control, adaptive transversal filters can be applied in the noise control system 30. Adaptive control is a special type of open loop active control in which the controller 25 employs a mathematical model of the vehicle's acoustic response, and possibly of the actuators and sensors. Due to the possible change of the acoustic environment over time, because of changes in temperature and other operating conditions for the vehicle 10, the adaptive controller 25 monitors the response, such as through the sensors 32 to identify the success of the noise control system 30 in controlling the generated noise, and continually or periodically updates the internal model of the system.

Alternatively, or as an optional addition to the speakers 35 and or vibrators 36, the plenum 20 can be lined with acoustic materials 27, 29, as are depicted in FIG. 4. Examples of this passive approach to sound management are acoustic damping materials, such as a damping sheet with a viscoelastic surface to provide a high damping over broad temperatures and frequency ranges. Acoustic absorption materials, such as acoustic foam 29, can provide maximum sound absorption with minimal thickness layers of foam applies to the surface of the sheet metal of the plenum 20 to reduce reverberation. Acoustic barrier materials, such as a heavy vinyl barrier 27 to block airborne sound with foam to reduce impact noise, provide maximum sound attenuation with high transmission loss. Coupling the passive acoustic materials with the active sound control system 30 can provide a highly capable noise control system, as is reflected in FIG. 4.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

For example, this noise control technology can be adapted and expanded for use in other vehicle structures, such as the wheel fender and trunk, wherever a fixed volume can be realized within the confines of the vehicle structure. Other applications of this noise control technology would include construction equipment, and other heavy equipment, the aerospace industry, and the heating, ventilation and air conditioning industry.

Having thus described the invention, what is claimed is:

1. An automotive vehicle, comprising: a chassis defining an engine compartment and a longitudinally spaced passenger compartment; an engine mounted in said engine compartment and being operable to generate noise energy along a transfer path into said passenger compartment; a transverse box-like structure interposed between said engine compartment and said passenger compartment having a constrained volume separate from the passenger compartment and having a transverse width sufficient to intercept the noise energy being transmitted from said engine to said passenger compartment along said transfer path, wherein the transverse box-like structure is a dual bulkhead plenum connected to an instrument panel located at a forward position in said passenger compartment; and a noise control system to control the transfer of said noise energy through said transverse box-like structure into said passenger compartment, said noise control system including: sensors operable to ascertain the acoustic environment of the vehicle and generate a signal indicative thereof; a controller operable to generate a mathematical model of the acoustic response from the signals generated by said sensors to define a predicted sound energy level therefrom; and a counteracting noise generating apparatus disposed within said box-like structure and being operably connected to said controller to produce a counteracting sound wave within said constrained volume to counteract the transmission of the predicted sound energy level within the constrained volume, wherein said counteracting noise generating apparatus includes at least one speaker mounted in said dual bulkhead plenum, said speaker being operable to generate said counteracting sound wave.

2. The automotive vehicle of claim 1 wherein said sensors include environmental sensors supported on said vehicle to sense operational conditions relating to said engine.

3. The automotive vehicle of claim 2 wherein said sensors further include response sensors positioned within said passenger compartment to ascertain the effectiveness of said noise control system.

4. The automotive vehicle of claim 3 wherein said controller is operable to update the mathematical model in response to the acoustic environment detected by said environmental and response sensors.

5. The automotive vehicle of claim 4 wherein said noise control system also includes a vibration generator mounted in said plenum to create a counter vibrational energy in said plenum, the operation of said vibration generator being controlled by said controller in response to the mathematical model being employed.

6. A noise control system operable with a noise generating apparatus producing generated noise energy and a passenger compartment located remotely from said noise generating apparatus to receive said generated noise energy, comprising: a plenum located along a transfer path of said generated noise energy extending between said noise generating apparatus and said passenger compartment, said plenum being located between said noise generating apparatus and said passenger compartment and having a constrained volume separate from the passenger compartment, wherein said plenum is a dual bulkhead structure connected to an instrument panel of an automotive vehicle located at a forward position in said passenger compartment of said vehicle; at least one sensor to sense an operational environmental condition; a controller operable to receive a signal from said at least one sensor, employ a control algorithm to generate a mathematical model of a predicted noise energy based on the sensed operational environmental condition, and generate a noise control signal to counteract said generated noise energy; and a counter energy generating device operably connected to said controller to receive said noise control signal and create a counter noise energy, said counter energy generating device being mounted within said plenum to counteract the transmission of said generated noise energy within said constrained volume before reaching said passenger compartment, wherein said noise energy is in the form of a generated sound wave having an amplitude and a frequency, said counter energy generating device being a speaker, said controller sending a signal to said speaker to generate a counter sound wave having a frequency and amplitude opposite to the corresponding amplitude and frequency of said generated sound wave to counteract said generated sound wave.

7. The noise control system of claim 6 wherein said controller is operable to modify said mathematical model in response to changes in said operational environmental condition.

8. The noise control system of claim 6 wherein said at least one sensor includes environmental sensors associated with said noise generating apparatus to detect operational environmental conditions, and response sensors associated with said passenger compartment to detect noise energy entering said passenger compartment, said controller being operable to receive signals from both said environmental sensors and said response sensors to modify said mathematical model.

9. A method of controlling a transmission of noise energy from a noise generating apparatus producing generated noise energy to a passenger compartment located remotely from said noise generating apparatus receiving said generated noise energy, comprising the steps of: intercepting said generated noise energy by a closed box-like structure positioned along a transfer path of said generated noise energy extending between said noise generating apparatus and said passenger compartment, said box-like structure having a constrained volume separate from said passenger compartment, wherein said box-like structure is a dual bulkhead plenum associated with an instrument panel of an automotive vehicle, said dual bulkhead plenum extending transversely of said vehicle forwardly of a passenger compartment of said vehicle; mounting a counter energy generating device within said constrained volume of said box-like structure along said transfer path; sensing operational environmental conditions at said passenger compartment relating to said noise generating apparatus; developing a mathematical model of predicted noise energy by a controller utilizing a control algorithm; generating a noise control signal by said controller in response to said mathematical model and sending said noise control signal to said counter energy generating device; and creating a counter noise energy by said counter energy generating device in response to said noise control signal to counteract the transfer of said generated noise energy along said transfer path within said constrained volume.

10. The method of claim 9 wherein said sensing step includes the steps of detecting said operational environmental conditions by environmental sensors associated with said noise generating apparatus and detecting generated noise energy received by said passenger compartment by response sensors, said method further comprising the step of: modifying said mathematical model in response to changes in said operational environmental conditions detected by said environmental sensors and said generated noise energy detected by said response sensors.

11. The method of claim 10 wherein said counter energy generating device is a speaker operable to create a counter sound wave, said generated noise energy including a generated sound wave having an amplitude and a frequency, said creating step generating said counter sound wave having a counter amplitude and a counter frequency to counteract said generated sound wave based on a modified predicted sound wave corresponding to said mathematical model.

12. The method of claim 10 wherein said counter energy generating device is a vibration generator operable to create a counter vibrational energy, said generated noise energy including a generated vibrational energy having an amplitude and a frequency, said creating step generating said counter vibrational energy having a counter amplitude and a counter frequency to counteract said generated vibrational energy.

* * * * *